United States Patent [19]

Robillard

[11] 4,395,472

[45] Jul. 26, 1983

[54] PLAIN PAPER REPRODUCTION PROCESS

[76] Inventor: Jean J. Robillard, 46 Arnold Rd., Pelham, Mass. 01002

[21] Appl. No.: 275,207

[22] Filed: Jun. 19, 1981

[51] Int. Cl.[3] ..... G03G 9/14; G03G 9/08

[52] U.S. Cl. ..... 430/47; 430/52; 430/99; 430/126

[58] Field of Search ..... 430/106, 109, 124, 126, 430/52, 99

[56] References Cited

U.S. PATENT DOCUMENTS

| | | | |
|---|---|---|---|
| 3,788,738 | 1/1974 | Takeuchi et al. | 355/17 |
| 4,224,396 | 9/1980 | Pollet | 430/109 |
| 4,230,784 | 10/1980 | Nishiguchi et al. | 430/109 |
| 4,246,331 | 1/1981 | Mehl | 430/106 |

*Primary Examiner*—John E. Kittle

*Assistant Examiner*—John L. Goodrow

*Attorney, Agent, or Firm*—Sherman & Shalloway

[57] ABSTRACT

Monochromatic or polychromatic photographic images are directly developed on plain paper by a photodielectric selective sublimable dye transfer process.

A photosensitive belt containing a photodielectric material and a binder is exposed to a light image and the exposed parts are then passed in contact with a plain paper together with a carrier of sublimable dye under pressure and the application of an electromagnetic field.

Multicolor images are formed by exposing the original through three separation filters; for example, red, blue and green on three successive areas of the photosensitive belt and each exposed area passed in contact with a plain paper and three successive carriers of sublimable dyes of color corresponding to the separation filters.

10 Claims, 7 Drawing Figures

AMPLIFICATION MECHANISM IN THE PHOTODIELECTRIC PROCESS

| TIME | ILLUMINATED AREA | DARK AREA | DENSITY | |
|---|---|---|---|---|
| $t_o$ (1) | $T_o$<br>$\varepsilon''_o$<br>$D_o$ | $T_o$<br>$\varepsilon''_o$<br>$D_o$ | Dark Dark<br>$t_o$ $D_o$ | $\varepsilon''_o = F(\phi, T)$<br>with applied RF field :<br>$T = F(\varepsilon''_o, \phi, V, T)$<br>$D = F(T)$<br>$\varepsilon''_o$ :Dielectric loss<br>$\phi$ :Light intensity<br>T :Temperature<br>t :time<br>V :RF voltage<br>D :Image Density |
| $t_1$ (2) | $T_1$<br>$\varepsilon''_o + \Delta\varepsilon''_o$<br>$D_1$ | $T'_1$<br>$\varepsilon''_o + \delta\varepsilon''_o$<br>$D_o$ | Light Dark<br>$t_1$ $D_1$ | |
| $t_2$ (3) | $T_2$<br>$\varepsilon''_o + \Delta(\varepsilon''_o + \Delta\varepsilon''_o)$<br>$D_2$ | $T'_2$<br>$\varepsilon''_o + \delta(\varepsilon''_o + \delta\varepsilon''_o)$<br>$D_o$ | Light Dark<br>$t_2$ $D_2$ | |
| $t_3$ (4) | $T_3$<br>$\varepsilon''_o + \Delta\left\{\varepsilon''_o + \Delta(\varepsilon''_o + \Delta\varepsilon''_o)\right\}$<br>$D_3$ | $\varepsilon''_o + \delta\left\{\varepsilon''_o + \delta(\varepsilon''_o + \delta\varepsilon''_o)\right\}$<br>$D_o$ | Light Dark<br>$t_3$ $D_3$ | |

FIG 2

SCHEMATIC OF RF GENERATOR

PLAIN PAPER REPRODUCTION PROCESS

BACKGROUND OF THE INVENTION

1. Field of the Invention

The present invention relates to a novel dry photographic recording system. In one aspect, the invention relates to the permanent monochromatic or polychromatic recording of images or objects on a plain paper by exposure on a photodielectric belt and subsequent formation of the image on the plain paper by passing the exposed area of the belt in an electromagnetic field, together with said plain paper and one or several sublimable dye carriers.

In another aspect, the invention relates to a new image recording system using the phenomenon of photodielectricity associated with dielectric heating and the selective sublimation of dyes.

In still another aspect, the invention relates to a new and novel photographic process in which an image is reproduced on plain paper without the use of electric charge transfer and toners.

In a further aspect, the invention relates to a new dry photographic process with higher sensitivity than other conventional dry processes.

2. Discussion of the Prior Art

Existing plain paper reproduction processes can be classified in two main categories: the electrographic processes and the ink jet processes.

Electrographic processes make use of a photoconductive drum or belt exposed to light after having been charged to a high electrostatic potential. The exposed parts lose their charge by photoconductive leakage and the remaining charge pattern is used to attract the particle of a toner in a liquid or dry medium. The toner is subsequently released to a plain paper sheet which has previously received opposite charges. The toner, which contains a low melting point polymer component, is then fixed by heat on the plain paper.

The main drawbacks of the electrophotographic process (Xerox) are the use of a toner, its high voltage and its limited sensitivity. (ASA:1).

In the ink jet process, one or several modulated ink jets are scanned on a plain paper in synchronization with an optical scanning of the image to be reproduced. The process can be polychromatic using inks of different colors.

Inconveniences of the ink jet processes are the complexity of the equipment, difficult maintenance and limited resolution.

SUMMARY OF THE INVENTION

It is an object of the present invention to provide a plain paper reproduction process without the use of toner or photoconductive components.

It is another object of the invention to provide a plain paper reproduction process with considerably higher sensitivity (speed) than the conventional electrographic reproduction process.

It is a further object of the invention to provide a plain paper reproduction apparatus with considerable reduction in size and price than the conventional electrographic reproduction processes.

It is a final object of the invention to provide a plain paper reproduction apparatus with easier maintenance than the conventional electrographic process.

The process, according to the invention, makes use of a photodielectric pigment dispersed in a binder and coated on a transfer belt. When the belt is exposed imagewise, a latent image is formed in terms of local variation of dielectric constants and dielectric losses in the material. The passage of the belt after exposure between the electrodes of a high frequency generator produces a thermal image by selective dielectric losses. The motion between the electrodes of the generator being made together with a plain paper and a film containing a sublimable dye, the heat generated imagewise causes the dye of the paper to sublime on the plain paper in a corresponding pattern, thereby producing an image on said plain paper. The heat generated during the formation of the image is generally sufficient to erase the latent image on the corresponding area of the photodielectric belt, which is then available for another exposure.

Sublimable dyes of different colors can be used to provide polychromatic images by repeating the above operation three times on the same plain paper with three different colored dyes (red, blue and green).

BRIEF DESCRIPTION OF THE DRAWINGS

FIG. 2 illustrates the sequence of operations leading to amplification in the image forming process according to the invention.

DETAILED DESCRIPTION OF THE INVENTION AND PREFERRED EMBODIMENTS

Figure 1:
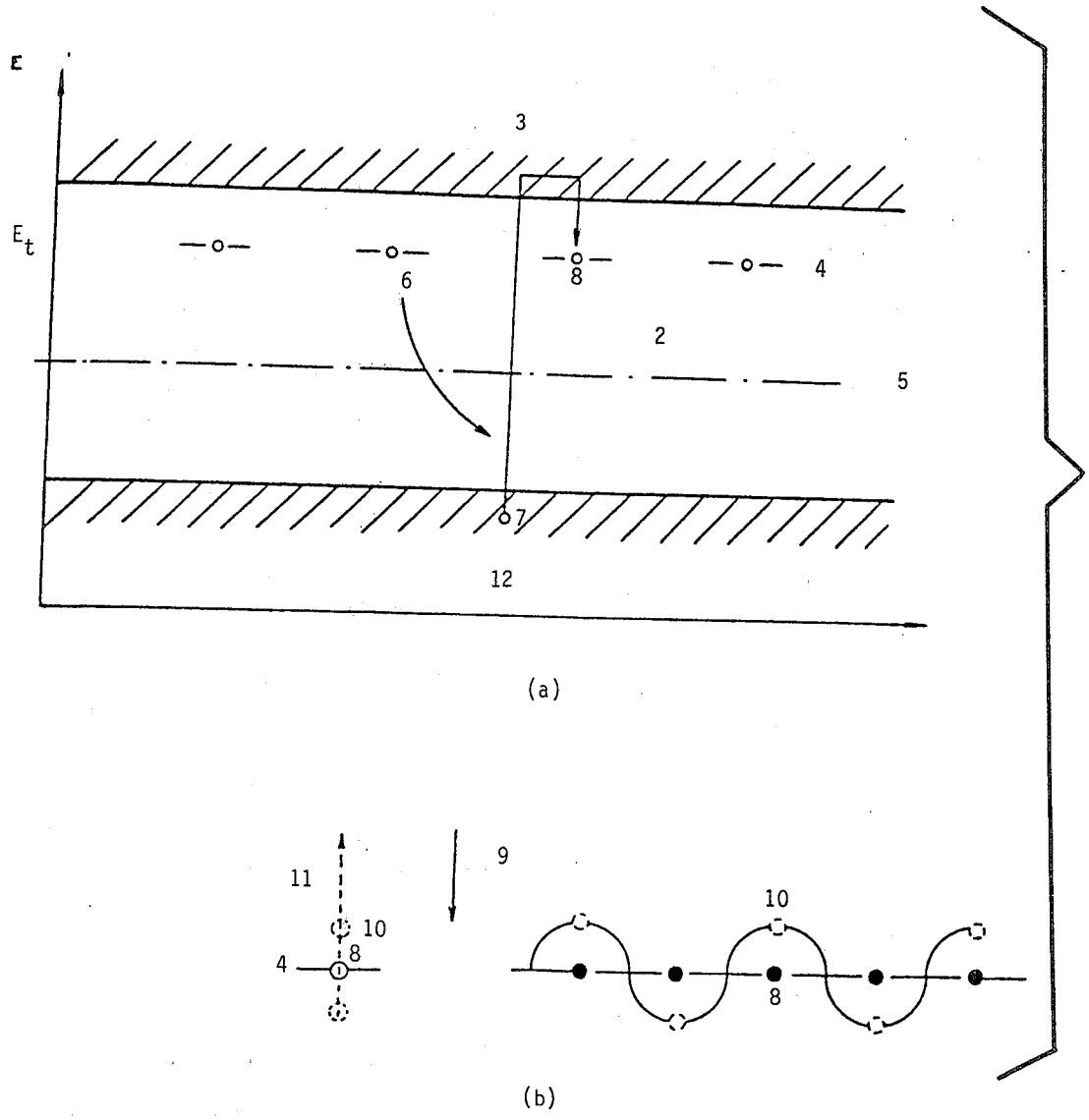
FIG. 1 illustrates the energy diagram of a semiconductor, the position of the trapping centers and the displacement of trapped electrons contributing to dipole action.

The photodielectric effect is the change in dielectric properties of a substance when exposed to radiation. This effect has been widely studied in relation to luminescence (J. H. Gisolf, "The dielectric losses of irradiated zinc sulfide phosphors", Physica VI, 918, 1939), electroluminescence (S. Roberts, "Dielectric changes of electroluminescent phosphor during illumination", J. Opt. Soc. Am. 43, 590, 1953), and thermoluminescence (J. Roux, "Effet photodielectrique, ferroelectricite, thermoluminescence, dans l'oxyde de zinc irradie par des rayons ultraviolets", Compte Rendus, 236, 2492, 1953) to which it is closely associated. The photodielectric effect is also related to methods using permanent internal polarization in electrets (V. M. Fridkin, Sci et Ind. Phot. 8, 331, 1959), which are now applied to certain kinds of electrostatic recording processes (V. M. Fridkin and I. S. Zhelvdev, "Photoelectrets and the Electrophotographic Process", Academy of Science, USSR, Moscow, p. 234–260, 1960).

It is known that the dielectric constant of a material is essentially a dipole effect and that it is made of the contribution of all elementary dipoles in the material. It is an expression of the ability for all of these dipoles to oscillate when exposed to an alternating field. Dielectric loss results from the existence of a relaxation time of the dipoles which causes phase differences between the applied alternating field and their oscillations. The nature of the dipolar contributions varies according to the type of material considered. It can be a microscopic contribution when the dipoles are made of individual elementary charges or small groups of such confined in a very small area. It is the case of polarization due to deformation of electron orbitals at atomic scale. Macroscopic contributions result from an unsymmetrical distribution of charges between atomic groups of a large molecule, as it is often the case in polymers. Such kinds of contributions also exist due to electric charges on the external faces of a film or between two faces of crystallites in a polycrystalline material.

In semiconductors, a microscopic but major contribution to the dielectric constant is due to trapped electrons. Under the influence of an alternating field, a trapped electron will oscillate with respect to the position of the trap and the system displaced electron trap makes an elementary dipole (see FIG. 1). The displacement of the electron and thereby the moment of the dipole will depend on the binding energy of the electron to its trap. As this binding energy depends on the energy level of the trap in the energy diagram of the material (FIG. 1), the contribution of the dipole to the dielectric constant will be a function of $E_t$.

The dielectric constant of a semiconductor material can be altered mainly by changing the number of dipoles in the material. If the change of the dielectric constant is stimulated by the absorption of light, it is a photodielectric effect.

When the traps in the semiconductor are empty, their dipolar contribution does not exist and the dielectric constant has a lower value $\epsilon$. The magnitude of the change:

$$\Delta\epsilon = \epsilon - \epsilon_0$$

is a function of the density of the traps in the material and their energy level $E_t$. For shallow traps the binding energy of the electron to its trap is relatively low (0.1 to 0.5 eV), allowing a large amplitude of oscillation and a higher value for the moment of the dipole. For deeper traps the situation is reversed. The photodielectric effect can therefore be optimized in semiconductor materials with shallow traps. There is, however, another consideration for the choice of the energy level of the traps. The contribution of the trapped electrons to the dielectric constant will also depend on their lifetime $\theta$ in the traps, and $\theta$ is decreasing rapidly for shallow traps as electrons can escape due to thermal agitation. A reasonable compromise has therefore to be achieved.

The semiconducting state being related to a defect structure, the presence of the defects in the bulk of the material will also create unsymmetrical charge distribution leading to dipolar effects.

In addition to bonded charge carriers there are also free charge carriers in a semiconductor recombination. In an unhomogeneous medium such as semiconductive pigments dispersed in a binder, because of the discontinuity in the dielectric constant, the free carrier will have a tendency to concentrate at the interfaces between the pigment particle and the binder. This will lead to a relaxation process affecting the overall dielectric constant.

The major contributions to the photodielectric effect are still trapped electrons (G. F. J. Garlick and A. F. Gibson, Proc. Roy. Soc. 188A, 485, 1947). The possible contribution of electrons in the conduction band appears to be negligible.

The change of the dielectric constant due to the trapping of electrons is naturally depending upon N (the density of trapping centers in the semiconductor). The manner in which this change will behave under various frequencies of the applied field depends on the coupling of the elementary oscillator represented by the trapped electron with the field. The mechanism of this coupling has been studied by Debye and others (Y. Lallemand, C.R. Symposium in Unconventional Photographic Systems, Royal Photographic Society, Oxford, September, 1977). The change $\Delta\epsilon$ can be expressed as:

$$\Delta\epsilon = \Delta\epsilon_\infty + \frac{\Delta\epsilon_0 \, \Delta\epsilon_\infty}{1 + \omega^2\tau^2}$$

where:

$\omega$ is the angular frequency.

$\Delta\epsilon_0$ and $\Delta\epsilon_\infty$ the variations of static and infinite frequencies.

$\tau$ is the relaxation time of the trapped electron.

The parameter most important for the present study is the dielectric loss which is related to the dielectric constant and can be derived from the results of Debye as well. The dielectric loss is generally expressed as a fictive parallel conductance $\gamma$. Its variation $\Delta\gamma$ will also vary with the applied field frequency according to:

$$\Delta\gamma = \frac{(\Delta\epsilon_0 - \Delta\epsilon_\infty) \cdot \omega^2 T}{3.6\pi \; 10^2 (1 + \omega^2\tau^2)}$$

However, it can also be expressed more conventionally as the variation $\Delta\epsilon''$ of the loss factor $\epsilon''$:

$$\Delta\epsilon'' = \frac{4\pi\Delta\gamma}{\omega} = \frac{(\Delta\epsilon_0 - \Delta\epsilon_\infty)\,\omega\tau}{0.9 \; 10^{12}(1 + \omega^2\tau^2)}$$

The variations of both the dielectric constant and the dielectric loss being a function of the number of filled traps are also a function of the temperature. This is particularly important in understanding the mechanism of amplification in the photodielectric process.

$\Delta\epsilon$ and $\Delta\epsilon''$ are also a function of the wavelength of the exciting light. The mechanism of generation of pairs hole electron is very similar to that of ordinary photoconductors, and the same techniques are available for spectral sensitization through the use of sensitizing dyes.

The development of the image in the process according to the invention is basically a dielectric heating process in which high frequency energy is selectively absorbed and creates temperature gradients in the belt material and the selective sublimation of the dye from the carrier onto the plain paper. The local heating rate will be a function of the dielectric properties of the material and its thermal properties.

The sensitivity of the process will depend on the characteristics of the sublimable dye.

For typical sublimable dyes the threshold temperature is of the order of 150° C. Also, the relative variation in the temperature rise between the irradiated and unirradiated areas is of the order of 60%.

If the heating rate were constant, this would be the order of magnitude of the relative change in the dielectric losses required to make an image. However, it has been found that lower relative changes were sufficient, which indicates that amplification occurs during the development.

Such an increase in the heating rate is obtained because the dielectric losses of the material increases with temperature in the range of temperature of interest that is between room temperature and 130° C. approximately.

The resolution is limited by thermal diffusion, and the shorter the development time, the shorter the diffusion length.

Physical amplification in the photodielectric process is mainly due to the influence of the temperature on the dielectric losses of the photosensitive material.

In the simplified mechanism of image formation, the initial change of dielectric losses $\Delta\epsilon_1''$ due to light exposure provides an increase in temperature $\Delta T_1$ in the RF field to which the film (or paper) is subjected in the development stage. But this change of temperature $\Delta T_1$ will also affect the dielectric loss $\epsilon''$ (as $\epsilon''=f(T)$) thereby creating an additional change of dielectric loss $\Delta\epsilon_2''$, which in turn will lead to another increase in temperature $\Delta T_2$, etc. The overall mechanism involves a feedback process whereby for an initial change in dielectric losses $\Delta\epsilon''$, due to a photonic contribution $h\nu$, the total resulting change in dielectric loss $\Delta\epsilon_t''$ is:

$$\Delta\epsilon_t''=\Delta\epsilon_1''+\Delta\epsilon_2''+\Delta\epsilon_3''+\Delta\epsilon_4''+\ldots+\Delta\epsilon_n''$$

or:

$$\Delta\epsilon''_t=\sum_{o}^{n}\Delta\epsilon''_n$$

and the total resulting change of temperature $\Delta T_t$ is:

$$\Delta T_t=\Delta T_1+\Delta T_2+\Delta T_3+\ldots+\Delta T_n$$

or:

$$\Delta T_t=\sum_{o}^{n}\Delta T_n$$

The amplification process is illustrated in FIG. 2.

The magnitude of the amplification is dependent on various factors associated with both the system and the properties of the photodielectric material.

Regarding the system, the factors influencing amplification will be:

a. The time delay $t_d$ between the exposure of the photosensitive substrate to light and to the RF field. This influence is due to the decay in the change of the dielectric constant with time, which behaves in a similar way to the decay of photoconductivity in photoconductors.

b. The time of exposure to the RF field $t_T$, which depends on the heat capacity $\epsilon_T$ of the various components of the photodielectric substrates and the heat diffusion coefficient between these various components. The contrast of the image will also be strongly dependent on $t_T$. The time of exposure $t_T$ will of course be related to the speed of development v.

c. The magnitude E of the RF field, which determines the amount of energy transferred to the photodielectric material to raise its temperature above the threshold of the sublimable dye. E will obviously be directly associated with the heat capacity $c_T$, the heat conductivity $k_T$ of the material and the time $t_T$. A higher electric field will raise the material to the threshold temperature faster.

d. The exposure time $t_e$ of the photodielectric material to the image will determine the initial $\Delta\epsilon''$ and therefore control the entire process. The $t_e$ should be sufficient to saturate the active traps in the material for optimum illumination (full contrast) but should not exceed the time necessary for this saturation.

e. The brightness B of the image (source) will affect the modulation of the final print. A proper relationship between B and $t_e$ will optimize the amplification and contrast of the final image.

The properties of the photodielectric material that will affect the amplification are electric, thermal and morphologic.

The electric properties that will contribute to the amplification are those which will vary with temperature. This dependency in semiconductors is different for free and bonded charge carriers. While the first contribution is not predominant in most semiconductors, it is by no means negligible.

In large gap semiconductors such as tin oxide, the conductivity results from the ionization of donors, and increases with temperature following:

$$\sigma=\sigma_o\exp-E/kt$$

For activation energies in the range 0.2 to 0.4 eV the conductivity will be increased by a factor 7 to 60 between room temperature and 120° C.

As we stated earlier, the major contribution to $\Delta\epsilon''$ is the trapped electrons whose density is a direct function of the temperature (V. M. Fridkin, Sci et Ind. Phot. 8, 331, 1959 and G. F. J. Garlick and A. F. Gibson, Proc. Roy. Soc. 188A, 485, 1947).

Another temperature dependent contribution which is directly related to the trapping of electrons in photoelectric materials is the thermally stimulated conductivity which is the promotion of trapped electrons into the conduction band by thermal excitation. This effect, of course, is characterized by a maximum in conductivity as the temperature is raised. The amplitude of this maximum is proportional to the heating rate.

The temperature at which the maximum occurs depends essentially on the depth level of the traps. They are related by:

$$E_t=AkT_m$$

where A is a factor which depends on the mechanism involved, and which has values between 15 and 26.

To get a maximum in the range of interest ($T_m$ of the order of 100° to 150° C.), for trapping levels must lie in the range 0.5 to 0.9 eV. The changes in dielectric losses can be important due to the high heating rates involved in the interaction between the RF field and the photosubstrate, which may be of the order of $10^3$ °C. per second.

Process which can lead to a maximum in this temperature range are processes with low activation energies and relatively high $\tau_o$; this is the case for trapped electrons.

The main advantage of this amplification mechanism is that it is selective. The increase of dielectric losses occurs only in the exposed areas where non equilibrium carriers have been stored.

After exposition by conventional optics, the development according to the invention takes place by passing the sensitive material through a set of electrodes energized by a RF field. In order to optimize the action of the field on the photodielectric substrate, the electrodes have to be very close, and sliding the material between them results in wear and damaging of the image forming substrate. For this reason, a rolling contact appeared to be necessary, and a set of rollers would replace the electrodes, but contact to this type of roller was difficult to come by at the RF frequency without excessive external losses.

Figure 3:
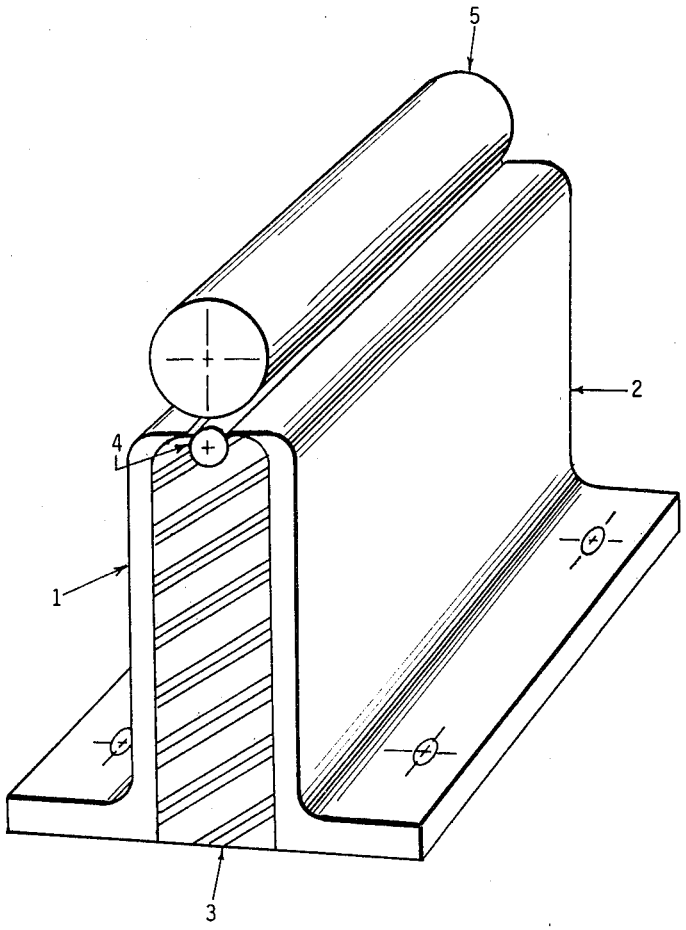
FIG. 3 represents a set of RF electrodes with a teflon roller to guide the photodielectric belt together with the plain paper and the sublimable dye carrier.

An optimal structure is represented in FIG. 3, where both electrodes are on the same side of the sensitive substrate and separated with a low loss dielectric (teflon), terminated by a free-rolling teflon cylinder rotating with a counter larger dielectric cylinder feeding the print in the field of the electrodes.

Figure 4:
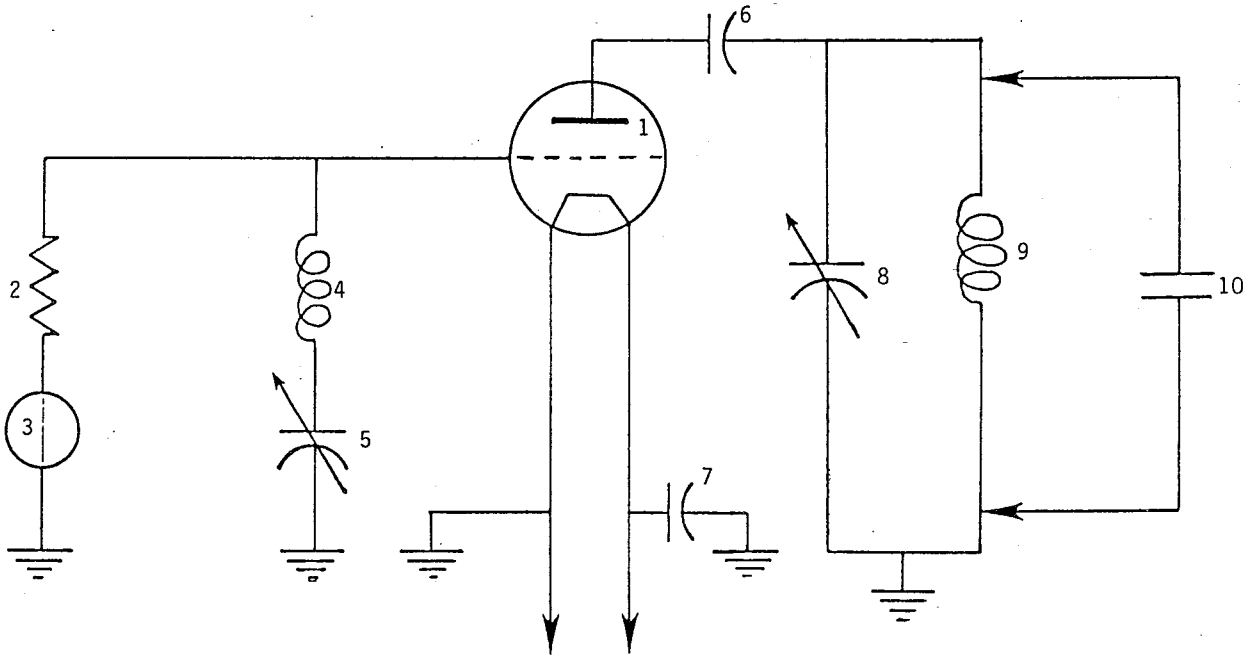
FIG. 4 is an example of the RF generator used for development of the image according to the invention.

Also, a number of RF generators have been used starting from standard generators for plastic welding to compact generators especially designed for the present application (FIG. 4).

The high frequency generator may be operated either in a continuous way, or by pulses or variable widths. In the first case, the sensitive layer is moved between the electrodes, the time of dielectric heating being equal to the time needed for the layer to move across the active area of the electrodes. In the second case, the layer is fixed and the time of dielectric heating is equal to the width of the pulse applied. This is to allow more precise evaluation of the kinetics of development. Optical density on the final image may be plotted versus dielectric heating time for various illumination levels.

Figure 5:
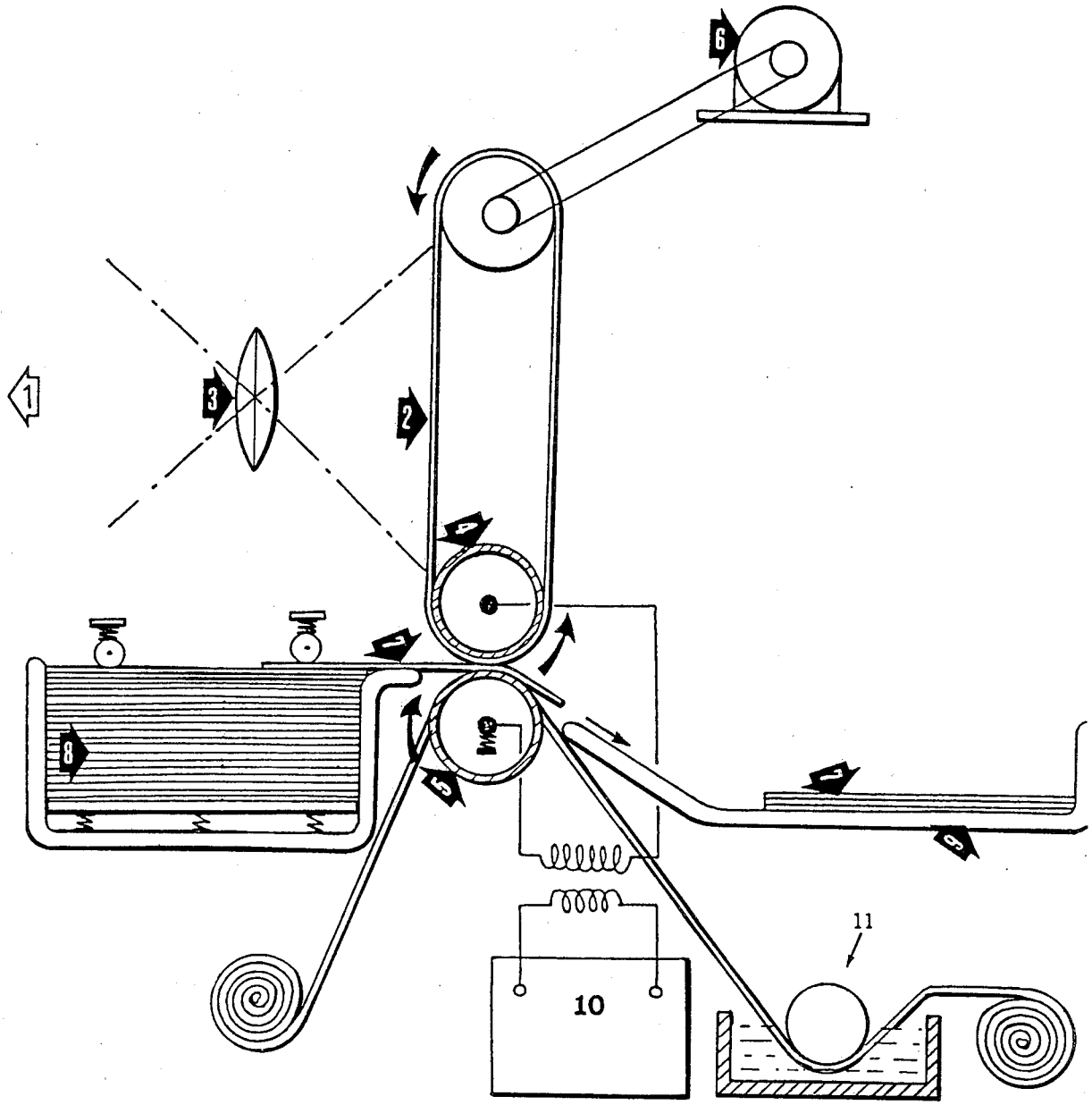
FIG. 5 is a schematic description of a photocopy machine utilizing the process according to the invention.

The exposure and development systems are represented schematically in FIG. 5. To produce an image on plain paper according to the invention, the photodielectric film, after exposure, is passed through the RF field together with a plain paper sheet and a carrier sheet (or ribbon) coated with a layer of sublimable dye. In this three components sandwich, the imagewise thermal gradient produces a selective sublimation of the dyes on the plain paper, thereby printing an image on it. The sublimation of the dye is due partly to a transfer of the heat gradient from the photodielectric sheet onto the plain paper and the dye carrier, and partly due to a selective generation of heat due to the losses in these two components of RF energy modulated by the photodielectric film.

The photodielectric system for plain paper printing according to the invention will be made of a photodielectric belt or drum, a set of electrodes, a RF generator and mechanical means to guide a paper sheet and a dye carrier ribbon between the electrodes. Such a system is represented in FIG. 5 with an alternative electrode system (see FIG. 6). For each printing, a certain quantity of dye will leave the ribbon to condense on the plain paper. The specific areas from which the quantity of dye has departed will not necessarily be the same for each transfer, therefore, the ribbon could be used many times in a manner similar to a typewriter ribbon. There are also possibilities to replenish that ribbon by heat transfer (see FIG. 5). The use of a dye transfer ribbon as consumable would not be more awkward than the ribbon of a typewriter and, at any rate, simpler than changing the toner in an electrostatic printer.

Figure 7:
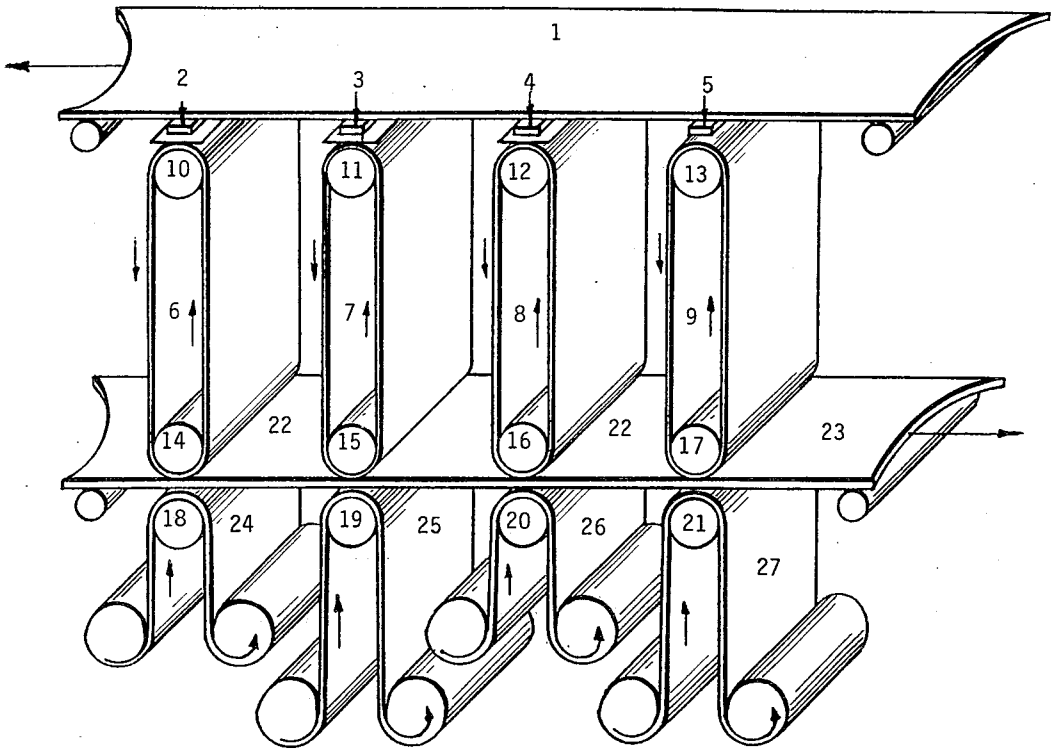
FIG. 7 is a schematic description of a photocopy machine for color reproduction according to the invention.

For color printing, the copier does essentially quadruplicate the structure of FIG. 5 with a supply of dyes (blue, green, red and black) provided from four ribbons. The system is represented in FIG. 7. The original is exposed linewise on the upper part of each belt through three types of filters: red, blue and green. The lower part of each belt is associated with a ribbon, providing a dye whose color corresponds to the color of the filter making the exposure. This general structure simplifies registering problems. The exposure of each line of the original for a given color modulates the release of dye from the corresponding ribbon onto the paper. The process is repeated four times leading finally to three superimposed color images corresponding each to a basic color and a black image for shadows.

The principle and embodiment of the invention process are schematically shown in FIGS. 1 to 7.

FIG. 1 shows the mechanism of electron trapping in a photodielectric pigment. The energy diagram of the material represented in FIG. 1(*a*) is made of three regions: the valence band 1, the forbidden zone or energy gap 2 and the conduction band 3. The trapping levels are represented in 4 and the Fermi level in 5. The absorption of a photon of light 6 promotes the band electron 7 from the valence band 1 onto the trapping center 8 where it contributes to an increase of the dielectric constant. This is shown in FIG. 1(*b*) where the trapped electron 8 is alternatively displaced under the application of a high frequency field 9. Number 10 represents the displaced electron forming with the trap 4 an elementary dipole.

FIG. 2 illustrates the sequence of operations leading to amplification in the image forming process where 1 represents the steady state before exposure, 2 represents the first variation of dielectric loss $\Delta\epsilon''$ after exposure, 3 represents the second variation of dielectric loss $(\Delta\epsilon_o''+\Delta\epsilon_o'')$ due to the increase in temperature when the RF field is applied, 4 shows how the dielectric loss continues to increase as the temperature increases due to previous increases in dielectric loss.

FIG. 4 is an example of a RF generator used for development of the image where 1 is the power tube, 2 is the grid resistor, 3 is the gird current meter, 4 is the coupling coil for the resonant circuit, 5 is a tuning capacitor, 6 and 7 are DC isolating capacitors, 8 is the resonant circuit capacitor, 9 is the resonant circuit coil and 10 represents the electrodes.

FIG. 3 represents a set of RF electrodes where 1 and 2 are the electrodes, 3 is an insulating body made of low dielectric loss material such as teflon, 4 is a dielectric roller of the same material to feed and guide the photodielectric belt, the plain paper and the sublimable dye carrier in the electrode field, 5 is a counter roller made of rubber or other dielectric materials whose action is to stretch and guide the lower part of the photodielectric belt and exert the proper pressure over the plain paper and the sublimable dye carrier over the electrodes 1 and 2.

FIG. 5 is a schematic description of a photocopy machine utilizing the process of the invention were the photodielectric belt 2 is exposed to an image 1 to reproduce through an optic 3. After exposure, the latent image formed on the exposed area of the belt is developed by passage between the electrode roller 4 and 5, together with the plain paper image receiving sheet 7 and the sublimable dye ribbon 12. The electrode rollers 4 and 5 are submitted to a high frequency electric field produced by the RF generator 10. Number 8 is a plain paper magazine and 9 is a receiving tray for printed papers. Number 11 is an optional replenisher for the sublimable dye ribbon. The belt, paper and ribbon are all set in motion through an electrical motor 6.

Figure 6:
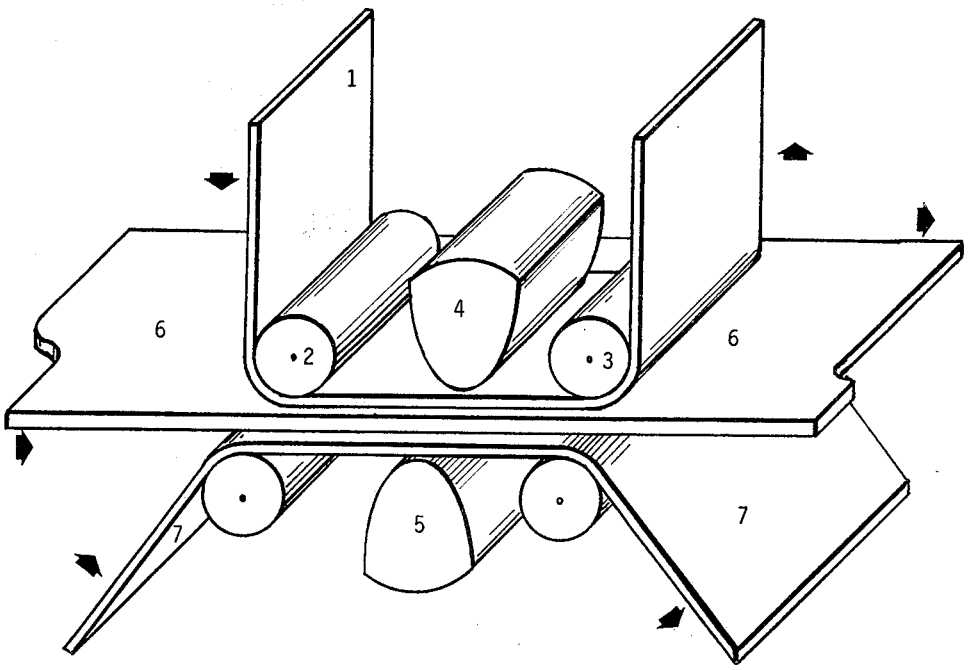
FIG. 6 is an alternative disposition of the RF electrodes for development of the image.

FIG. 6 is an alternative disposition of the RF electrodes for development of the image according to the process where the photodielectric belt 1 is guided by two sets of rubber rollers 2 and 3, whereas the RF electrodes 4 and 5 are disposed on the straight part of the belt, applying the RF field vertically between the photodielectric belt 1, the plain paper image receiving sheet 6 and the sublimable dye ribbon 7, which is guided in the same manner between a set of rubber rollers 8 and 9. The rollers 8 and 9 are exerting a certain pressure of their counterparts 2 and 3 in order to stretch all three components: photodielectric belt, plain paper and dye ribbon in the field region between electrodes 4 and 5.

FIG. 7 is a schematic description of a photocopy machine for color reproduction according to the invention. It consists essentially of the repetition of the elements in FIG. 5. The colored original 1 passes successively in front of a fiber optic projection system with a blue filter 2, an identical system with a green filter 3, another like system with a red filter 4 and a fiber optic projection system without filter 5. A photodielectric belt 6, sensitized in the blue, is stretched between a rubber roller 10 and a roller electrode 14. Another photodielectric belt 7, sensitized in the green, is stretched between a rubber roller 11 and a roller electrode 15. A third photodielectric belt 8, sensitized in the red, is stretched between a rubber roller 12 and a roller electrode 16. A fourth photodielectric belt 9, sensitized for the three elementary colors, red, blue and green, is stretched between a rubber roller 13 and a roller electrode 17. The plain paper image receiving sheet 22 passes successively in contact with the lower extremities of belts 6, 7, 8 and 9 at the same speed in synchronization with the displacement of the color original 1. On the other side of the plain paper receiving sheet and respectively opposite to electrode rollers 14, 15, 16 and 17, a blue sublimable dye ribbon 24 is pressed against paper 22 between electrode rollers 14 and 18; a green sublimable dye ribbon 25 is pressed against paper 22 between electrode rollers 15 and 19; a red sublimable dye ribbon is pressed against paper 22 between electrode rollers 16 and 20 and a black dye sublimable ribbon is pressed against paper 22 between electrode rollers 17 and 21. An external RF generator provides a high frequency field between, respectively, electrodes 14 and 18, 15 and 19, 16 and 20, 17 and 21. The motion of the original 1 in one direction results in the formation of a color copy 23 moving in the opposite direction at the same speed.

The photodielectric belts are made of a plastic strip, the extremities of which are fastened together to provide a continuous belt. This belt is coated on the outer surface with the photodielectric layer.

Materials suitable as plastic for the photodielectric belt are polymers with low dielectric losses, such as: teflon, nylon, silicone rubber, hevea rubber, etc.

The photodielectric layer is formed from a composition which includes an intimate mixture of a photodielectric pigment, a spectral snesitizer and a binder.

The following photodielectric pigments can be mentioned as representative examples of the photodielectric pigments which change their dielectric constant and dielectric loss factor when exposed to light: zinc oxide, tin oxide, germanium oxide, titanium oxide, lead oxide, zirconium oxide, cerium oxide, and most of the rare earth oxides, zinc sulfide, cadmium sulfide, antimony sulfide and copper sulfide.

The spectral sensitizers which can be used in the composition of the photodielectric layer include: rose bengal, thioflavine, auramine, thionine, fluorescein, eosin, aeridin orange, methylene blue, crystal violet, the 1-1′ diethyl, 2-2′ cyanine, etc.

Suitable binders for the photodielectric compositions include binders of low dielectric losses, such as: butadiene, styrene, butadiene copolymers, nylon, silicone resins, etc.

The thermosublimable dye ribbon is made of a plastic substrate coated with the sublimable dye dispersed in a binder. Plastic materials suitable as substrates for the sublimable dye ribbon are polymers with low dielectric losses, such as: teflon, silicone, polyester, rubber, hevea rubber and silicone resin impregnated papers. The width of the roll of plastic (ribbon) corresponds to the width of the final printed copy on plain paper.

The composition of the sublimable dye coating includes:

a. A dispersed dyestuff with appropriate sublimation temperature. Said dyestuff belonging to three general categories:

Nitroarylamine dyes
Azo dyes
Anthraquinone dyes.

A number of modifications of these dyes exist on the market under several trade names, such as: Acetamine (Du Pont), Acetoquinone (Ugine-Kuhlman), Artisil (Sandoz), Celliton (BASF), Cibacete (Ciba-Geigy), Duranol (I.C.I.), Esteroquinone (Ugine-Kuhlman), Foron (Sandoz), Latyl (Du Pont), Palanil (BASF), Resoline (Bayer) and Setacyl (Ciba-Geigy).

b. A fluid carrier, such as: water, methanol, ethylene glycol, toluene, etc.

c. A thickener to provide the right viscosity, such as: various latexes, ethyl cellulose, polyvinyl acetate, acrylic resins, shellac, commercial resins, such as Serviprint (Chemloid) or AC Polyethylene (Allied Chemical).

d. A lacquer or resin to provide adhesive properties, such as natural gums or a special latex such as Servigum (Chemloid).

Coating compositions with components a through d are found commercially under the following trade names: Aquatex (Coates Bros), Alkatex (Coates Bros), Fabigems (Edward Marsden), Flexatrans (Fishburn Printing), Heatra (Colora Printing Inks), Rototran (Fishburn Printing), Sublivure (Usher and Walker), Subliscreen (Sericol), Teraprint (Ciba-Geigy), Transelts (Winnetts, Ltd.), Transmak (Mander Kidd), Transtex (Coates Bros) and Unitex (Coates Bros).

The invention will now be described in connection with specific embodiments which are provided as illustrative examples only, and not by way of limitation.

EXAMPLE 1

A. Belt

The following composition:

| | |
|---|---|
| $SnO_2$ | 40 g |
| Pliolite S5-E (Goodyear) | 8 g |
| Toluene | 100 cc |

-continued

| | |
|---|---|
| Acridine Orange | 8 mg |
| Thioflavine T | 8 mg |

is ball milled for twenty-four hours and coated on an acrylic substrate to a thickness of 10 microns. The substrate is thereafter made to a belt by fastening its extremities, the coated part forming the outside of the belt.

B. Sublimable dye ribbon

The following composition:

| | |
|---|---|
| Teraprint blue 5R (Ciba-Geigy) | 10 cc |
| Serviprint (Chemloid) | 2 cc |
| Servigum (10% solution) (Chemloid) | 30 cc |
| Water | 58 cc |

is coated on a 50 micron thick polyester film to a coating weight of 120 g/m$^2$.

EXAMPLE 2

A. Belt

The following composition:

| | |
|---|---|
| ZnO | 40 g |
| Cariflex (Shell) | 10 g |
| Toluene | 72 g |
| Rose Bengal | 8 mg |
| Eosin | 8 mg |
| Titan Yellow | 8 mg |

is ball milled for twenty-four hours and coated on a nylon substrate to a thickness of 10 microns. The substrate is thereafter made to a belt by fastening its extremities, the coating being on the outside.

B. Sublimable dye ribbon

The following composition:

| | |
|---|---|
| Teraprint blue R (Ciba-Geigy) | 10 cc |
| Serviprint (Chemloid) | 2 cc |
| Servigum (Solution 10%) (Chemloid) | 30 cc |
| Water | 58 cc |

is coated on a 75 micron polyimide film (Kapton) to a coating weight of 200 g/m$^2$.

EXAMPLE 3

A. Belt

The following composition:

| | |
|---|---|
| CdS | 34 g |
| Cyanamid Resin 341-17 | 13 g |
| Acetone | 27 g |
| Auramine | 8 mg |
| Methylene blue | 8 mg |
| Erythrosine | 8 mg |

is ball milled for twenty-four hours and coated on a teflon substrate to a thickness of 20 microns. The substrate is thereafter made to a belt by fastening its extremities, the coated part forming the outside of the belt.

B. Sublimable dye ribbon

The following composition:

| | |
|---|---|
| Teraprint red 3G (Ciba-Geigy) | 10 cc |
| Serviprint (Chemloid) | 2 cc |
| Servigum (Solution 10%) (Chemloid) | 30 cc |
| Water | 58 cc |

is coated on a 75 micron teflon film to a coating weight of 200 g/m$^2$.

EXAMPLE 4

A. Belt

The following composition:

| | |
|---|---|
| ZnS | 40 g |
| Pliolite S5-E (Goodyear) | 8 g |
| Toluene | 100 cc |
| Thioflavine T | 8 mg |
| Acridine Orange | 8 mg |

is ball milled for twenty-four hours and coated on a nylon substrate to a thickness of 10 microns. The substrate is thereafter made to a belt by fastening its extremities, the coated part forming the outside of the belt.

B. Sublimable dye ribbon

The following composition:

| | |
|---|---|
| Teraprint yellow 2G | 20 cc |
| Serviprint (Chemloid) | 2 cc |
| Servigum (Solution 10%) (Chemloid) | 30 cc |
| Water | 48 cc |

is coated on a 100 micron polyisoprene film to a coating weight of 150 g/m$^2$.

EXAMPLE 5

A. Belt

The following composition:

| | |
|---|---|
| $SnO_2$ | 40 g |
| Pliolite S5-E (Goodyear) | 8 g |
| Toluene | 100 cc |
| Acridine Orange | 8 mg |
| Thioflavine T | 8 mg |

is ball milled for twenty-four hours and coated on a nylon substrate to a thickness of 30 microns. The substrate is thereafter made to a belt by fastening its extremities, the coated part forming the outside of the belt.

B. Sublimable dye ribbon

The following composition:

| | |
|---|---|
| Sublaprint yellow 70,000 (Holliday) | 10 g |
| Sublaprint red 70,011 (Holliday) | 20 g |
| Servigum 0154 (Chemloid) | 30 g |
| Water | 1000 cc |

is coated on a 75 micron paper impregnated with a silicone resin to a coating weight of 250 g/m$^2$.

EXAMPLE 6

A. Belt

The following composition:

| | |
|---|---|
| $TiO_2$ | 50 g |
| Cyanamid Resin 341-17 | 13 g |
| Acetone | 27 g |
| Toluene | 28 g |
| Auramine | 8 mg |
| Eosin | 8 mg |
| Crystal Violet | 8 mg |

is ball milled for twenty-four hours and coated on a teflon substrate to a thickness of 10 microns. The substrate is thereafter made to a belt by fastening its extremities, the coated part forming the outside of the belt.

B. Sublimable dye ribbon

The following composition:

| | |
|---|---|
| Latyl yellow 3G (Du Pont) | 3.5 g |
| Resoline red FB (Bayer) | 3.5 g |
| Violet Foron BL (Sandoz) | 13 g |
| Gum Arabic | 30 g |
| Water | 1000 cc |

is coated on a 200 micron cellulose triacetate film to a coating weight of 200 g/m$^2$.

EXAMPLE 7

A. Belt

The following composition:

| | |
|---|---|
| $ZrO_2$ | 50 g |
| Cariflex (Shell) | 10 g |
| Toluene | 72 g |
| Fluorescein | 8 mg |
| 1-1' diethyl 2-2' cyanine | 8 mg |
| Methylene blue | 8 mg |

is ball milled for twenty-four hours and coated on a polyester substrate to a thickness of 20 microns. The substrate is thereafter bent into a belt, fastening its extremities with the coating on the outside.

B. Sublimable dye ribbon

The following composition:

| | |
|---|---|
| Celantrene blue FFSK (Du Pont) | 5 g |
| Sublaprint yellow 70,000 (Holliday) | 10 g |
| Gum Arabic | 30 g |
| Water | 1000 cc |

is coated on a 75 micron teflon film to a coating weight of 250 g/m$^2$.

What is claimed is:

1. A light sensitive photographic process for producing a permanent record on plain paper of a light image which comprises: (a) exposing to said image the surface of a photodielectric recording medium supported on a plastic belt, said photodielectric medium comprising a layer of a homogeneous intimate mixture of photodielectric pigments dispersed in a binder which exhibits a change of dielectric constant and dielectric loss factor in those areas of said photodielectric recording medium exposed to said light image and forming as a result of exposure to said image a latent image in terms of local variations of dielectric constant and dielectric loss factor in said photodielectric recording medium; (b) contacting the surface of said exposed photodielectric recording medium with the surface of a plain paper image receiving sheet backed with a plastic substrate coated with an image forming medium comprising a dispersion of sublimable dyes in a binder, the surface of said image forming medium being in contact with said plain paper image receiving sheet; (c) impressing a high frequency electric field through said photodielectric recording medium, plain paper image receiving sheet and image forming medium to provide the sublimation of the sublimable dyes of said image forming medium in selected areas corresponding to said light image onto said plain paper receiving sheet by selective generation of heat due to dielectric losses in said photodielectric recording medium, said heat generation in said photodielectric recording medium being substantially proportional to the change in dielectric constant and dielectric loss factor in said photodielectric recording medium according to the previous exposure of said medium to said radiation image, thereby producing a photographic record of the image made of sublimed dyes from said image forming medium onto said plain paper image receiving sheet.

2. A process according to claim 1 wherein the photodielectric pigment is selected from the group consisting of: zinc oxide, tin oxide, lead oxide, zirconium oxide, bismuth oxide, antimony oxide, aluminum oxide, cerium oxide, zinc sulfide, cadmium sulfide, copper sulfide, lead sulfide, antimony sulfide and cadmium telluride.

3. A process according to claim 1 wherein the sublimable dyes in said image forming medium are selected from the group consisting of: Anthraquinone dyes, Azo dyes and Nitroarylamine dyes.

4. A process according to claim 1 wherein the binder in said photodielectric medium is selected from the group consisting of: butadiene, styrene, butadiene copolymers, nylon and silicone resins.

5. A process according to claim 1 wherein the plastic belt is made of a material selected from the group consisting of: teflon, polyethylene and polystyrene.

6. A process according to claim 1 wherein said plastic substrate of said image forming medium is made of a material selected from the group consisting of: teflon, polyethylene, polystyrene, polyester, nylon and silicone impregnated paper.

7. A process according to claim 1 wherein the photodielectric pigment of said photodielectric medium is sensitized in the blue region of the spectrum, and the sublimable dye in said image forming medium is a blue dye.

8. A process according to claim 1 wherein the photodielectric pigment of said photodielectric medium is sensitized in the green region of the spectrum, and the sublimable dye in said image forming medium is a green dye.

9. A process according to claim 1 wherein the photodielectric pigment of said photodielectric medium is sensitized in the red region of the spectrum, and the sublimable dye in said image forming medium is a red dye.

10. A process according to claim 1 for multicolor copying of a multicolor light image which comprises providing a first photodielectric medium wherein the photodielectric pigment is sensitized in the blue region of the spectrum and a first image forming medium wherein said sublimable dye is a blue dye; providing a second photodielectric medium wherein the photodielectric pigment is sensitized in the green region of the spectrum and a second image forming medium in which the sublimable dye is a green dye; and providing a third photodielectric medium wherein the photodielectric pigment is sensitized in the red region of the spectrum, and a third image forming medium in which the sublimable dye is a red dye; exposing the surface of the first photodielectric recording medium to the multicolor light image through a blue filter, contacting the surface of the exposed first photodielectric recording medium with the surface of said plain paper image receiving sheet backed with a plastic substrate coated with said first image forming medium; exposing the surface of the second photodielectric recording medium to the multicolor light image through a green filter, contacting the surface of the exposed photodielectric recording medium with the surface of said plain paper image receiving sheet backed with a plastic substrate coated with said second image forming medium; exposing the surface of the third photodielectric recording medium to the multicolor image through a red filter, contacting the surface of the exposed photodielectric recording medium with the surface of said plain paper image receiving sheet backed with a plastic substrate coated with said third image forming medium; and impressing a high frequency electric field through each of said photodielectric recording media, plain paper image receiving sheet and each of said image forming media to provide the sublimation of the blue, green and red sublimable dyes, respectively, of said image forming media in selected areas corresponding to the multicolor light image to produce blue, green and red images, respectively, to thereby produce a photographic record of the multicolor image on said plain paper image receiving sheet.

* * * * *